United States Patent [19]

Onal et al.

[11] 4,031,844

[45] June 28, 1977

[54] DUAL JET BOAT PUMP

[75] Inventors: Hasan F. Onal, Oceanside; Clarence R. Harmon, Rancho Sante Fe, Calif.

[73] Assignee: Hydro-Tech Corporation, Denver, Colo.

[22] Filed: Mar. 11, 1976

[21] Appl. No.: 665,908

Related U.S. Application Data

[63] Continuation of Ser. No. 621,818, Oct. 14, 1975, abandoned, which is a continuation of Ser. No. 447,749, March 4, 1974, abandoned.

[52] U.S. Cl. ..... 115/12 R; 415/204; 60/222

[51] Int. Cl.[2] ..... B63H 11/02

[58] Field of Search ..... 115/12 R, 12 A, 14, 115/15, 16; 60/221, 222; 415/120, 121, 203, 204

[56] References Cited

UNITED STATES PATENTS

| | | | |
|---|---|---|---|
| 2,024,274 | 12/1935 | Campini | 115/16 |
| 2,625,110 | 1/1953 | Hentjens et al. | 415/204 |
| 3,082,732 | 3/1963 | Stallman | 115/12 A |
| 3,128,740 | 4/1964 | Burgin | 60/222 |
| 3,422,788 | 1/1969 | Horan, Jr. | 115/12 R |
| 3,805,731 | 4/1974 | Furst et al. | 115/16 |

FOREIGN PATENTS OR APPLICATIONS

| | | | |
|---|---|---|---|
| 1,271,928 | 8/1961 | France | 115/16 |

OTHER PUBLICATIONS

"Waterjet Propulsion Systems" Study Contract No. bs88605, Project Serial No. ss-600-000, Task 1722. (Lockheed).

*Primary Examiner*—Trygve M. Blix
*Assistant Examiner*—Douglas C. Butler
*Attorney, Agent, or Firm*—Wegner, Stellman, McCord, Wiles & Wood

[57] ABSTRACT

A double suction, double volute pump for propelling a boat having each volute exhaust through a separate jet nozzle. The pump housing defines two intake passageways leading upward to either side of a double suction impeller. The housing further provides double volutes which receive water from each side of the double suction impeller and deliver it to dual nozzles thereby creating twin jets which may be employed to propel and control the boat. The double volutes each extend substantially full circle about the housing and terminate in elbows which lead to the nozzles. The nozzles are placed horizontally equidistant from the centerline of the impeller shaft and are controlled by steering linkages to operate in unison. Reversing control gates may be operated either together for reversing or independently for slow speed steering.

5 Claims, 8 Drawing Figures

DUAL JET BOAT PUMP

This is a continuation, of application Ser. No. 621,818 filed Oct. 14, 1975, which is a continuation of Ser. No. 447,749, filed Mar. 4, 1974 both now abandoned.

The present invention is directed to propulsion pumps for boats. More specifically, the present invention is directed to a dual jet boat pump.

Pumps are employed in combination with power units for propelling boats in place of propellers and other conventional systems. These pumps generally suck water from underneath the boat and discharge it laterally in the form of a single jet. The resulting impulse drives the boat in the opposite direction. Generally, axial mixed flow pumps are employed in such boat applications. In these axial pumps, the impeller discharges directly into a central outlet having stator blades located therein and being shaped at the discharge end to form a single nozzle.

A radial flow boat pump having double inlets and double volutes rather than a central axial mixed flow passageway has been developed which discharges through a single outlet jet. This pump is disclosed in a co-pending application entitled *Jet Boat Pump*, Ser. No. 382,374, filed July 25, 1973, now abandoned, assigned to the assignee of the present invention. The present invention constitutes an improvement on the boat pump disclosed in the above application, the disclosure of which is incorporated herein by reference.

The present invention is directed to a double suction, double volute pump having dual jets which are directed laterally for jet propulsion of the boat. Water is drawn into the pump through scoops extending downwardly from the main portion of the pump housing. This incoming water is directed to both sides of a double suction impeller located centrally within the housing. The impeller then accelerates and distributes the water into two opposed volutes. Each of these volutes is wrapped substantially full circle about the impeller cavity. At the end of each volute, the water is directed through a nozzle laterally aft to form the propelling jets. This double volute and double nozzle configuration provides for hydraulic balance within the pump and a balanced casting. The balanced casting design simplifies the housing casting procedures and promotes a more uniform wall thickness in the casting. Further, the dual jet configuration provides simplified and balanced outlet paths. With a single jet, it is necessary that the nozzle be centered behind the boat. With the dual jet configuration, it is only preferable that the resulting impulse vector is centered behind the boat. Thus, the jets may be positioned at any convenient distance from the centerline of the boat.

The extension of the volutes substantially full circle about the central impeller helps to increase the pump efficiency. The extended volutes gently reduce the velocity of the accelerated water exiting from the impeller. This creates a slow transition from a high kinetic energy level to high pressure level. Further, twisting of the volute passageway to direct the water aft is delayed until energy to high pressure. This is believed to help reduce the turbulence within the volutes resulting in an increase in efficiency and an improved jet. A further advantage of this dual jet system is that two smaller jets are employed rather, than a single larger jet. This reduces the effects of the water jet on a skier when the system is used for water sking.

A steering and control system is employed using vertical vanes located within the nozzles for horizontal directional changes and control gates for reversing the flow to power the boat backwards. This system naturally gives a substantial amount of control which is further enhanced by independently operable reversing control gates that can be used like twin screws to turn the boat at low speed.

Accordingly, it is an object of the present invention to provide an efficient jet boat pump employing dual jets.

It is another object of the present invention to provide a jet boat pump wherein each of two volutes terminates in a separate nozzle thereby creating a dual jet boat pump.

It is a further object of the present invention to provide a jet boat pump wherein a slow transition is provided for the water exiting from the impeller from high kinetic energy to high pressure in volutes extending substantially full circle about the impeller cavity.

It is yet another object of the present invention to provide a jet boat pump having a substantial increase in low speed manuverability through the use of dual jets.

Other and more detailed objects and advantages will appear hereinafter.

Figure 1:
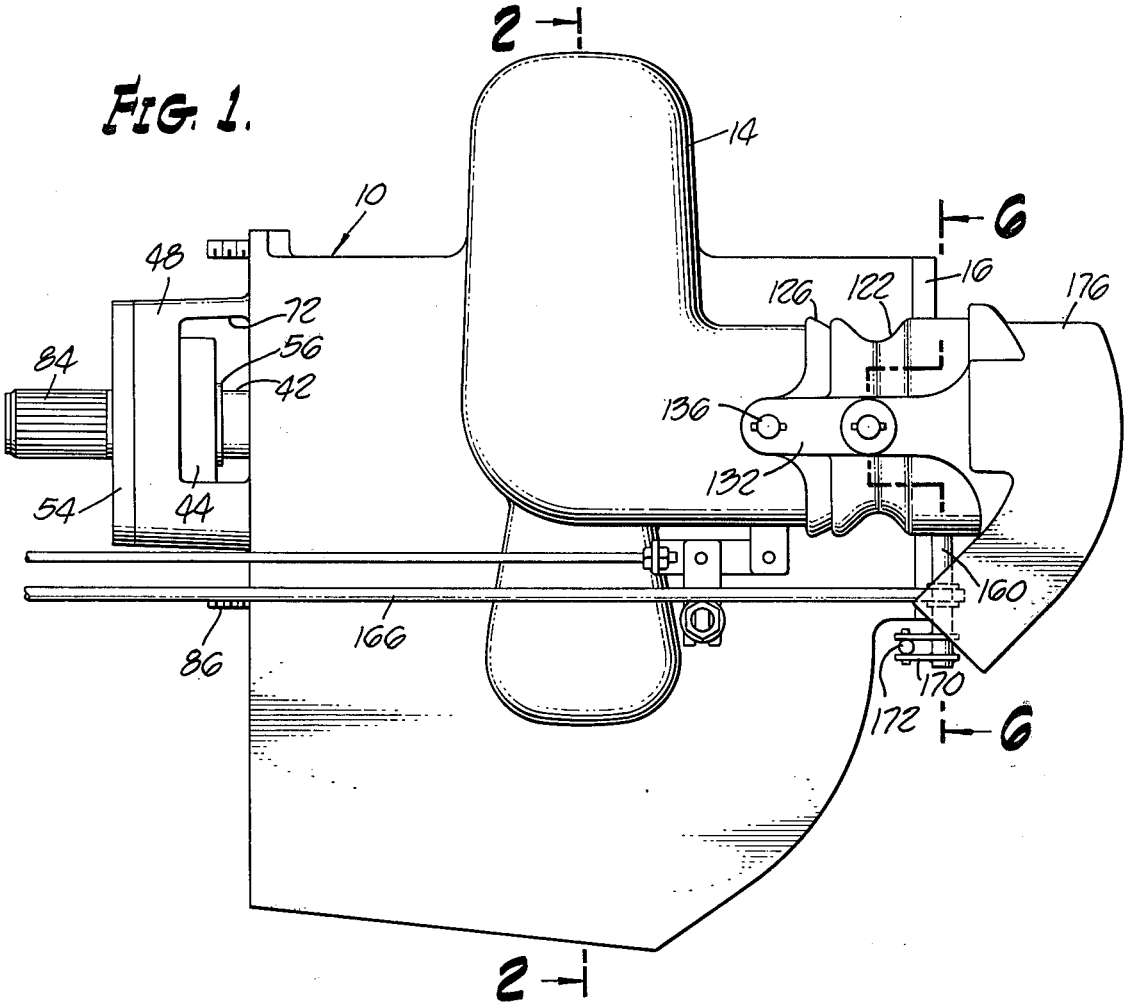
FIG. 1 is a side elevation of the present invention.
Figure 8:
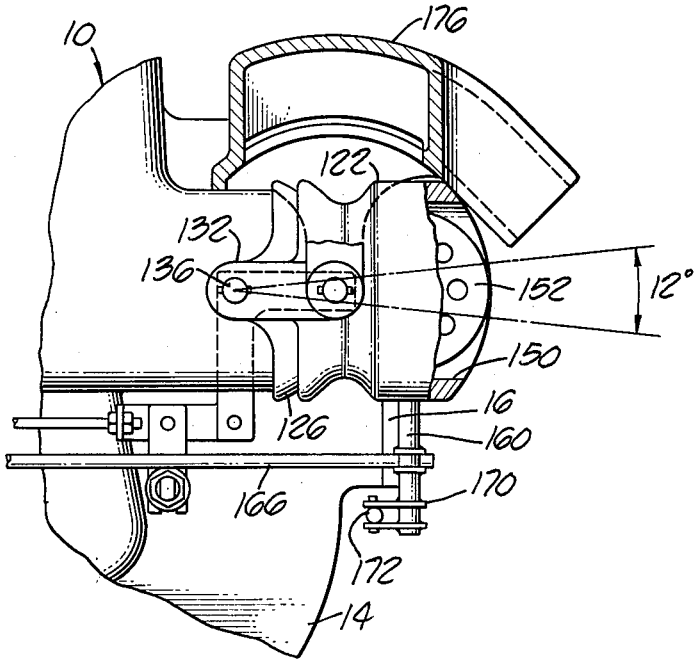

FIG. 8 (is a side view detailing the nozzle configuration with the control gate shown in cross section and positioned for forward propulsion of the boat.

Figure 2:
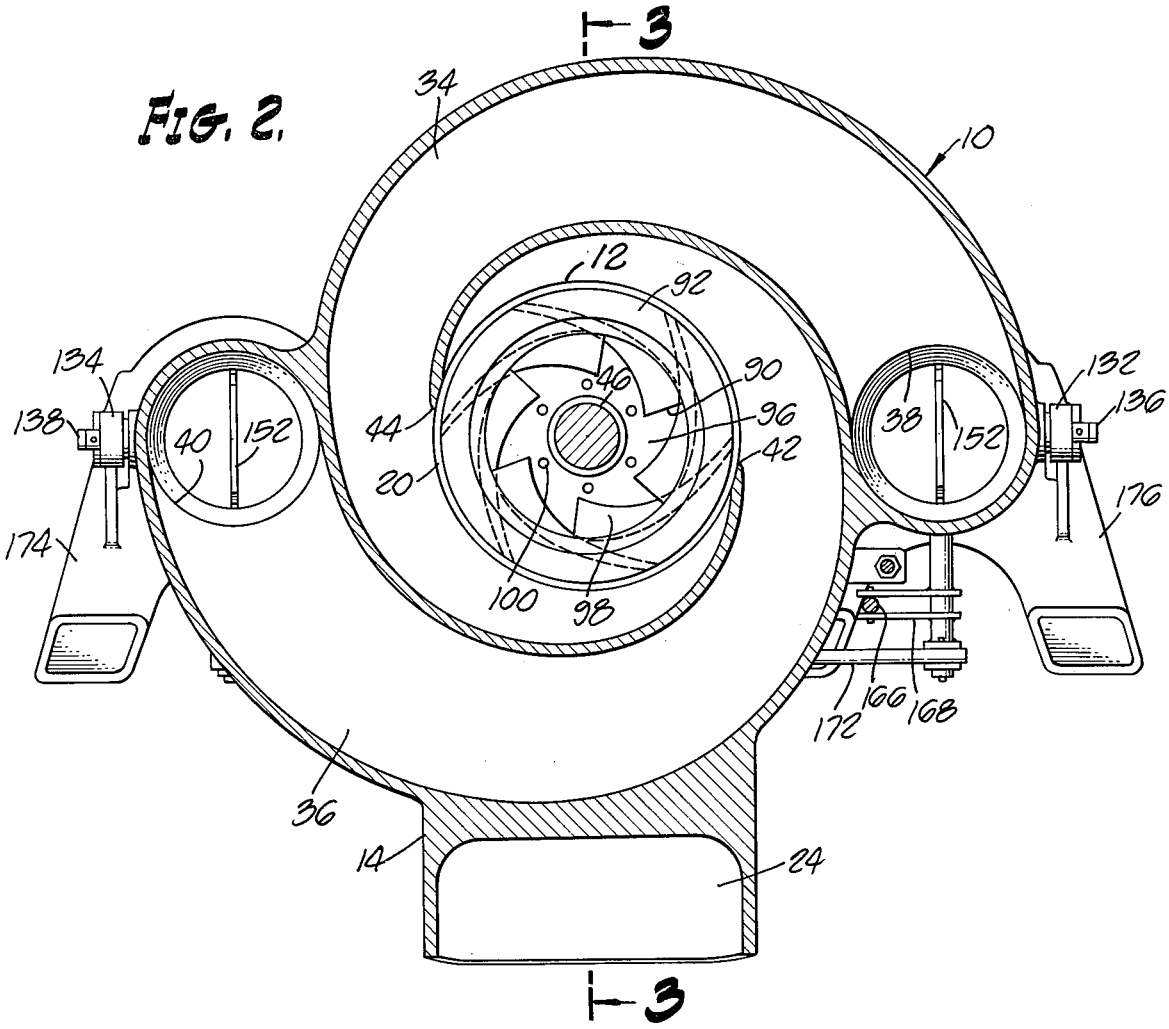
FIG. 2 is a cross-sectional elevational taken along line 2—2 of FIG. 1.
Figure 3:
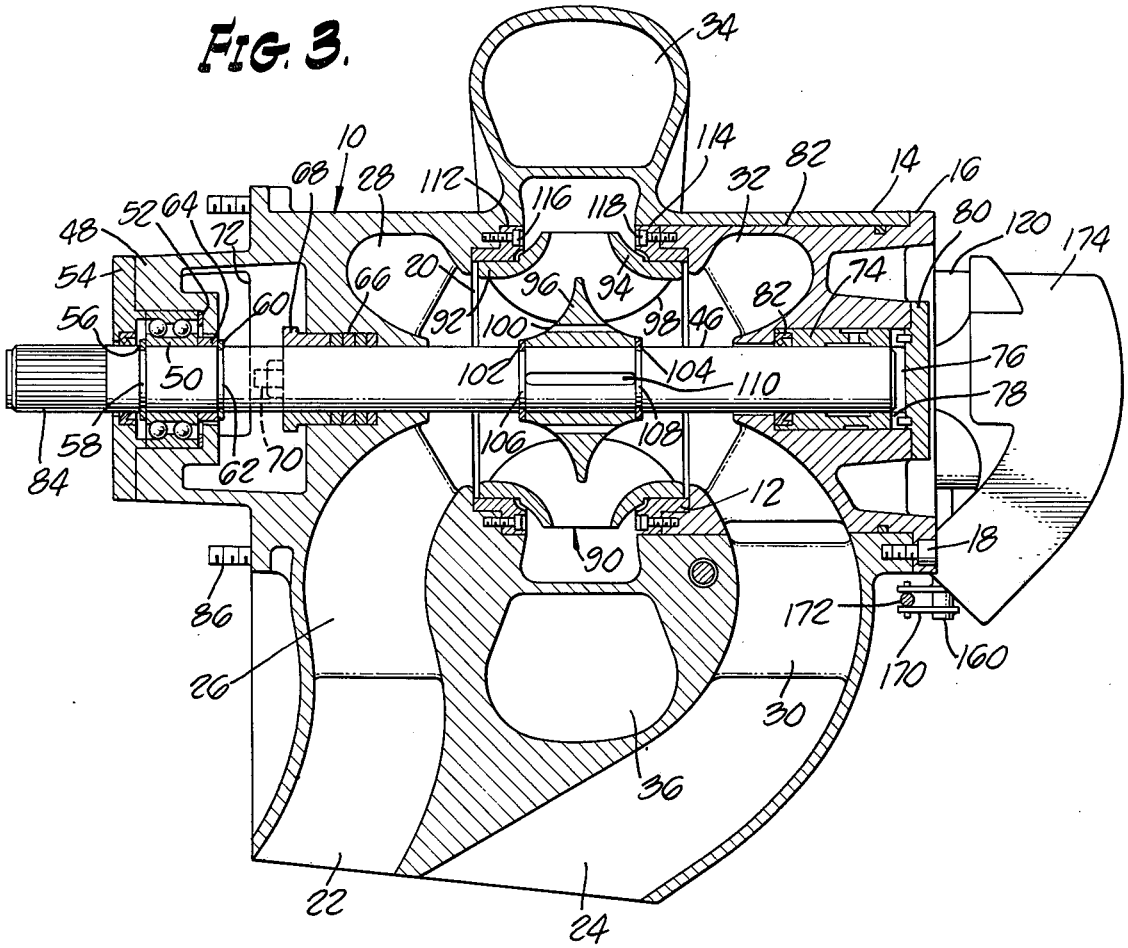
FIG. 3 is a cross-sectional elevation taken along line 3—3 of FIG. 2.
Figure 6:
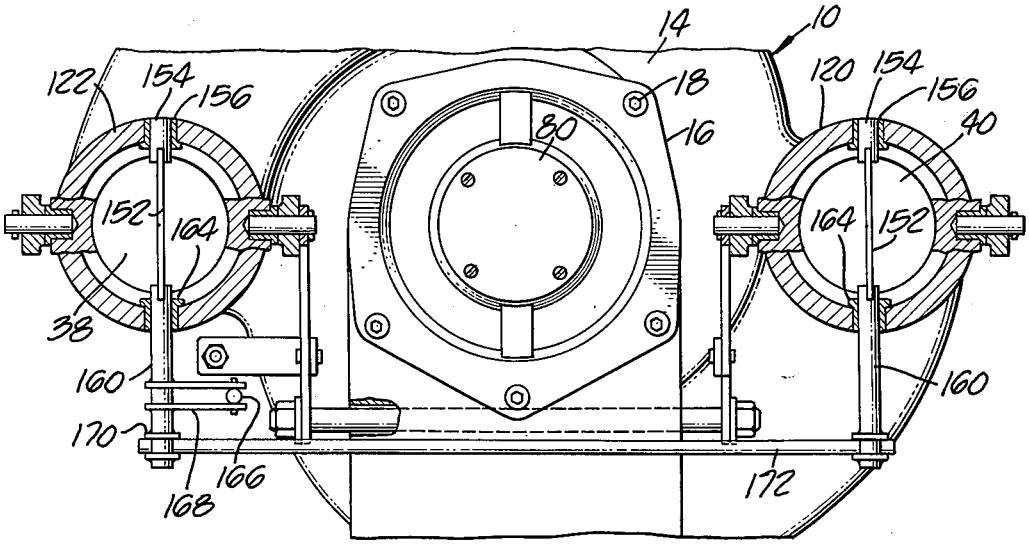
FIG. 6 is an end view taken in cross section along line 6—6 of FIG. 1.
Figure 4:
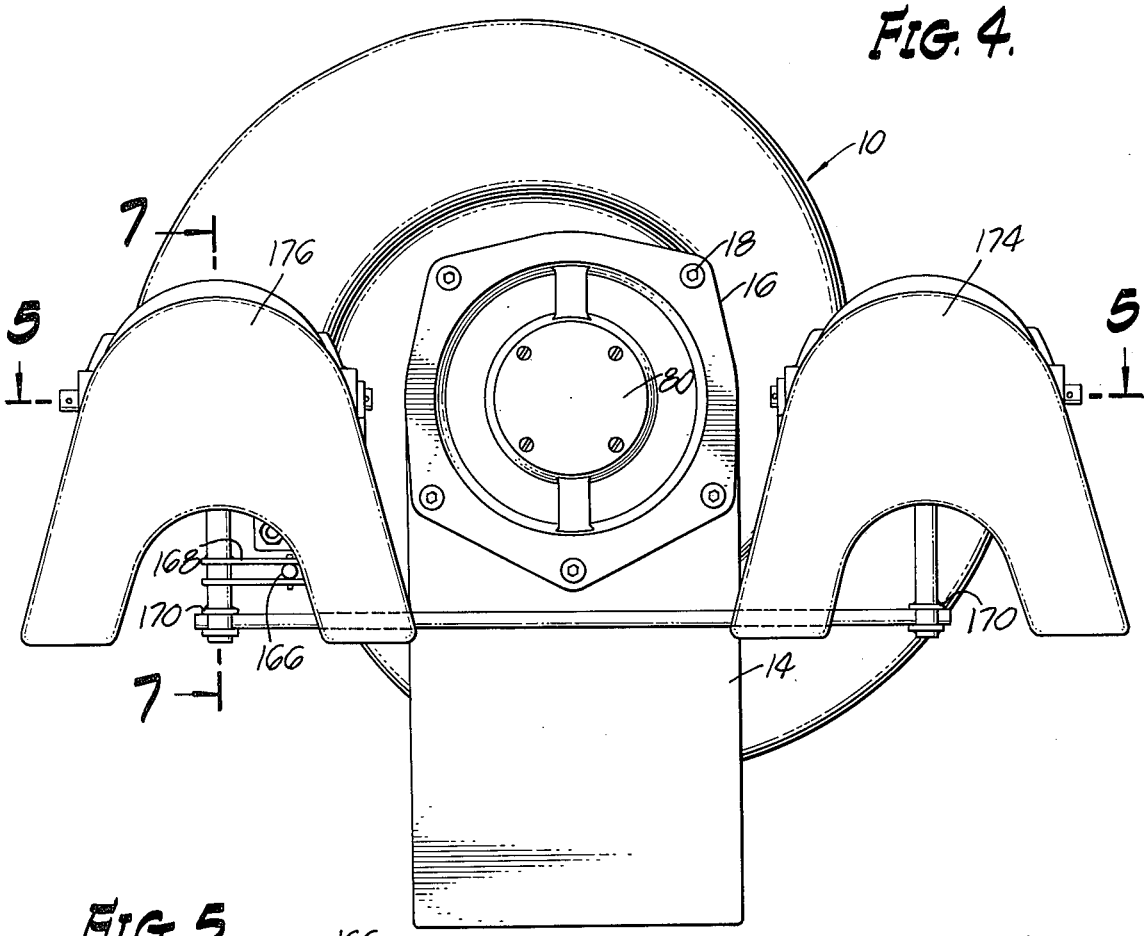
FIG. 4 is an end view of the present invention.

Turning specifically to the drawings, a pump housing, generally designated 10, is illustrated as employing a single casting with a cylindrical insert to provide access to the center of the unit. The interior of the casting 10 is best seen in FIGS. 2 and 3. Defined within the casting and insert are inlet passage means for drawing water into the pump, outlet passage means for discharging water from the pump and a cavity for the pump. The housing 10 generally takes on the shape of the various passages and cavities contained therein in order that the wall thickness of the casting and the resulting overall weight may be reduced.

The housing 10 is split into two portions about a cylindrical parting surface 12 concentrically disposed relative to the shaft of the pump. The housing then is divided into a main housing 14 and a substantially cylindrical insert 16. The insert 16 is retained on the main housing 14 by bolts 18. With the insert positioned in the main housing 14, a pump cavity 20 is defined centrally within the housing 10. Access to the pump cavity 20 may be obtained through disassembly of the housing 10 by removing the substantially cylindrical insert 16. The breaking of the housing 10 along a cylindrical parting surface eliminates the difficulties associated with a horizontal parting surface. With a horizontal part, high pressure is developed within the pump cavity which tends to divide the two parts of the housing. Leaking is quite often the result. In the present housing structure, the substantially cylindrical insert 16 is primirily in association with the intake side of the pump which is maintained at a reduced pressure during operation. Only a small portion of the insert 16 is subjected to high pressure in the pump. Thus, the possibility of leakage and pump failure is substantially reduced.

The inlet passageway means are here defined as two intake passageways 22 and 24 extending from below the pump upwardly about the pump cavity 20. In this way, water may be drawn from the body of water in which the boat is supported. Centered in the passageway 22 is a baffle 26 which helps stabilize the flow and prevents circular motion of the flow about the housing. A second baffle 28 is provided centrally in the upper portion of the inlet passageway 22. The inlet passageway extends in a circular path in either direction between baffles 26 and 28 to provide incoming water to the total inlet area of the pump cavity 20. A similar configuration is provided for the intake passageway 24 including baffles 30 and 32. The intake passageway 22 distributes incoming water to one side of the pump cavity 20 and inlet passageway 24 distributes incoming water to the other side of the pump cavity 20.

The outlet passage means for directing water from the pump are defined in the present embodiment as two volutes 34 and 36 terminating in elbows 38 and 40 which in turn lead to outlets from the pump. The two volutes 34 and 36 defined by the housing 10 increase in cross-sectional area from the leading edges 42 and 44 to the ends thereof at elbows 38 and 40. This continuously increasing cross-sectional area associated with each volute 34 and 36 allows for a slow transition between the kinetic energy developed in the water by the pump and the high pressure developed at the nozzle ends of the volutes. Starting at the leading edges 42 and 44, the two respective volutes 34 and 36 extend substantially full circle to the elbows 38 and 40. This extended volute design further enhances the slow transitional effect of the two volutes 34 and 36. The volutes also spiral about the housing substantially in a plane. This provides for a reduced overall length of the pump unit. The two volutes 34 and 36 are naturally formed about the central impeller cavity 20 in the direction in which the impeller rotates. This circumstantially results in a more compact design.

The elbows 38 and 40 are also cast within the pump housing 10. The elbows 38 and 40 redirect the water flowing through the volutes 34 and 36 rearwardly in order that a propelling reaction impulse may be experienced. This direction change in the flow of water through the volutes is accomplished at a point where a substantial amount of the velocity of the water has been converted to pressure. This relatively late directional change is therefore accomplished with a minimum of energy losses. The elbows 38 and 40 are spaced equally from the center of the boat pump. When the horizontal components of the distances from the centerline of the pump to the resulting water jets are equal, the resulting impulse vector will be centered behind the boat. Thus, the boat will be driven by the jets in a straight line. The equal vertical placement of the nozzles helps provide a uniform trim. This centering of the impulse vector using two jets eliminates the need for a goose neck configuration necessary for centering the thrust from a single jet, boat pump.

A pump shaft 46 extends centrally through the housing 10. The pump shaft 46 is rotatably mounted in bearings at either end thereof. At the forward end of the pump housing 10, a bearing housing 48 is formed in the casting. A bearing assembly 50 is mounted on the pump shaft 46 within the bearing housing 48. The bearing is positioned between a shoulder 52 and a bearing cap 54. The inner race of the bearing assembly 50 is located relative to the pump shaft 46 by means of a first snap ring 56 located in a groove 58 in the pump shaft 46. A second snap ring 60 is located in groove 62. A spacer 64 is positioned between the bearing assembly 50 and the second snap ring 60. Inwardly from the bearing assembly, packing material 66 is provided about the pump shaft 46. The packing material 66 is retained by a packing retainer ring 68 held in place by two studs 70. Access is obtained to the packing material 66 through holes 72 located in the casting.

A bushing 74 is provided at the rearward end of the pump shaft 46. The bushing 74 is located in a cavity 76 formed in the housing. A spacer 78 positions the bushing 74 in the cavity 76. An end cap 80 retains the entire bushing assembly. A seal 82 keeps water in passageway 24 from the bushing 74. Thus, the bearing assembly 50 and the bushing 74 constrain the pump shaft 46 to rotation about a fixed axis. To bring about such rotation, the pump shaft 46 extends forward from the bearing cap 54 to mate with the power plant. Splines 84 transfer the torque to the pump shaft 46. The housing is attached to the transom of the boat through studs 86 and the bearing housing 48 extends through the transom along with the pump shaft 46.

Means are provided for imparting energy to the water which is drawn into the pump. In the present embodiment, a double suction impeller 90 is employed for this function. The double suction impeller 90 is fixed to the pump shaft 46 within the pump cavity 20. The double suction impeller 90 is similar to that disclosed in the incorporated U.S. application, Ser. No. 382,374. The impeller 90 includes shrouds 92 and 94, a central hub 96 and vanes 98. Holes 100 extend through the central hub 96 to help establish equal pressure on either side of the double suction impeller 90. The impeller 90 is constrained to a fixed position on the shaft 46 by means of snap rings 102 and 104 positioned in grooves 106 and 108 on the pump shaft 46. The impeller 90 is constrained to rotate with the pump shaft 46. This may be accomplished by means of a key positioned in keyway 110.

Two wear rings 112 and 114 are positioned within the housing 10 to provide a sealing means between the pressure side and the suction side of the impeller. The wear ring 112 is bolted directly to the main housing 14 by means of bolts 116. The wear ring 114 is similarly bolted to the housing insert 16 by means of bolts 118. The wear rings 112 and 114 have grooves set in helical paths on the surfaces in mating relationship with the impeller 90. The impeller 90 has similar grooves. These grooves help to keep the impeller 90 from freezing to the wear rings 112 and 114.

Figure 7:
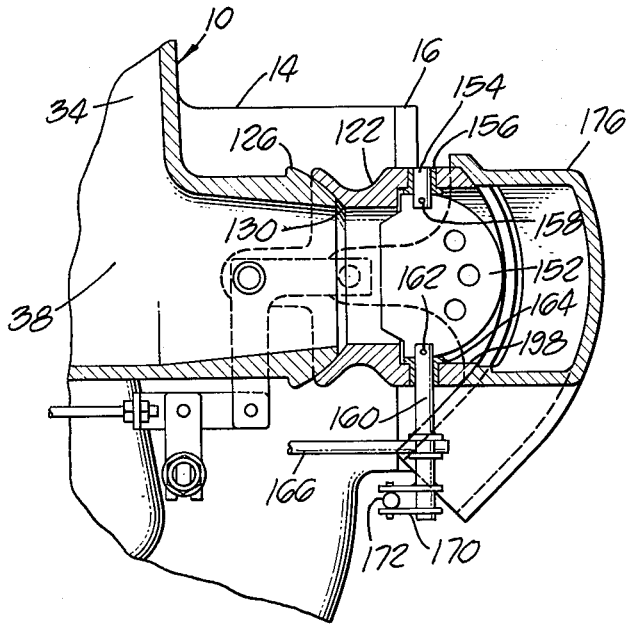
FIG. 7 is a cross-sectional side view taken along line 7—7 of FIG. 4.
Figure 5:
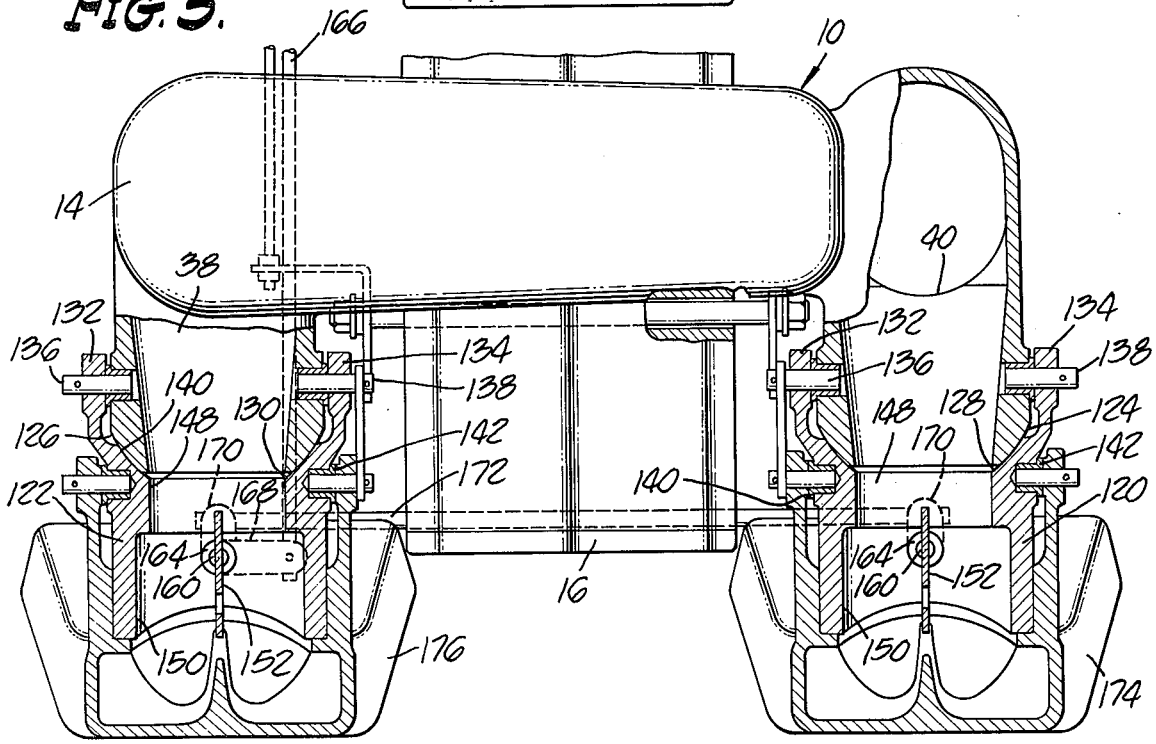
FIG. 5 is a top view partially taken in cross section along line 5—5 of FIG. 4.

Outlets are provided to finally control the jets of water as they exit from the pump to propel a boat. Pivotally mounted to the elbows 38 and 40 are control nozzles 120 and 122. The elbows 38 and 40 direct flow rearwardly to the control nozzles 120 and 122 which further direct the water from the pump. The elbows 38 and 40 are tapered to constrict the cross-sectional area of the passageways as the water flows rearwardly therefrom. This taper is best illustrated in FIGS. 5 and 7. It is believed that a taper of 3¼ inches per foot is satisfactory. At the outer end of the elbows 38 and 40, spherical surface 124 and 126 are provided. The spherical surfaces 124 and 126 mate with corresponding spherical surfaces 128 and 130 located on the forward end of the control nozzles 120 and 122. Clevis lugs 132 and 134 are provided on each control nozzle 120 and 122. The clevis lugs 132 and 134 cooperate with pins 136 and 138 to pin the control nozzles 120 and 122 to the ends of the elbows 38 and 40. The pins 136 and 138 are held in inserts 140 and 142 which are positioned in holes located through the elbows 38 and 40. Thus, each control nozzle 120 and 122 may be pivoted about a horizontal axis. This introduces the capability of trim control to the boat using the control nozzles 120 and 122.

The control nozzles 120 and 122 each include a cylindrical bore 148 aligned with the tapered bore of the elbows 38 and 40. Extending from the circular bore 148 is a larger cylindrical cavity 150 which houses steering deflector vanes 152. The steering deflector vanes are mounted to pivot about a vertical axis extending through the centerline of the exhausting jet stream. Each deflector vane 152 is conveniently shaped as shown in FIG. 7 and is mounted on a short vertical pin 154 extending through the upper most portion of the respective control nozzle 120 and 122. A low friction insert 156 is provided about the pin 154. The deflector vane 152 extends into a slot provided in the pin 154 and is held therein by means of a fixed pin 158. A second vertical pin 160 extends upwardly through the bottom of each respective control nozzle 120 and 122 to receive the bottom of each of the deflector vanes 152. The second vertical pin 160 is similarly attached to the deflector vane 152 by means of a fixed pin 162. A similar insert 164 is provided about the second vertical pin 160 in the control nozzle. Thus, mounted, the deflector vanes 152 may be pivoted about the vertical axis to effect directional control of the exhausting jets for steering of the boat.

The deflector vanes 152 steer the boat in a right turn by rotating counterclockwise as seen from above. The water on the right side of the jet is deflected toward the right. The water on the left side of the jet is naturally drawn along the surface of the deflector vane 152 and thereby also is deflected toward the right. A portion of each vane 152 extends upstream of the pivot axis defined by pins 154 and 160. In this way, the upstream portion of each deflector vane 152 will tend to cut off the side of the jet toward the outside of the turn.

Steering control of the deflector vanes 152 is accomplished through a steering control rod 166 which is pivotally connected to a lever arm 168. The lever arm 168 is fixed at a distance from the steering control rod 166 to the second vertical pin 160 on the left hand control nozzle 122. Fore and aft motion of the control rod 166 results in rotational motion of the second vetical pin 160 which effects steering through the steering deflector vane 152 in the left hand control nozzle 122. Also attached to the left hand vertical pin 160 is a second lever arm assembly 170. A similar lever arm assembly 170 is included on the right hand vertical pin 160. A tie rod 172 extends between the left and right hand lever arm assemblies 170. The tie rod 172 is pivotally mounted to each of the lever arm assemblies 170 and rotational motion of the left hand vertical pin 160 will result in similar rotational motion of the right hand vertical pin 160 which in turn causes the right hand steering deflector vane 152 to track the motion of the left hand steering deflector vane 152. Thus, both jets are deflected in an identical manner for control of the boat.

Attached to the control nozzles 120 and 122 are reversing control gates 174 and 176. The reversing control gates 174 and 176 operate in a substantially identical manner to the reversing control gates illustrated in the incorporated co-pending U.S. application, Ser. No. 382,374. A substantial advantage of the dual jet configuration disclosed in the present embodiment employs the reversing control gates 174 and 176. Specifically, during low speed manuvering, the reversing control gates 174 and 176 may be independently operated to effect a steering capability similar to that available with twin screw boats. This effect is brought about by lowering the appropriate reversing control gate down over the nozzle 120 and 122. The other control gate is retained above the opposite control nozzle. When power is provided to the pump, one jet will continue aft while the opposite jet is directed forward. The resulting is a couple which will bring about rotational motion of the boat without substantial fore or aft motion.

Thus, an efficient boat pump is provided which incorporates the dual jet configuration for added versatility and efficiency. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A pump for propelling a boat, comprising:
a pump housing having a central impeller cavity;
inlet passage means communicating with the said impeller cavity;
a substantially horizontal pump shaft extending centrally through and being rotatably mounted in said housing;
an impeller positioned within said impeller cavity and fixed to rotate with said shaft;
dual discharge volutes communicating with said impeller cavity, said dual volutes extending about said central impeller cavity and terminating laterally at opposite sides and at the level of said shaft;
a pair of elbows associated respectively one with each of said dual volutes and each having a first part formed by an end of a volute, and each one of said elbows including a bend to have a second part extending rearwardly beside said housing with said second parts in spaced parallel relation generally at the level of said shaft; and
a pair of non-rotatable discharge nozzles mounted directly one on each of said second elbow parts adjacent said bends with the discharge ends of said discharge nozzles at generally the same level as said second elbow parts and directed rearwardly in the same direction as said second elbow parts to minimize the length of the fluid confinement thereby reducing friction losses and providing a compact construction.

2. The pump of claim 1 wherein said impeller is a double suction, radial flow impeller.

3. The pump of claim 1 wherein said volutes spiral about said impeller substantially in a plane.

4. The pump of claim 1 wherein said discharge nozzles each include a vertically disposed deflector vane for high-speed steering control and a pair of independently operable reversing control gates providing low-speed steering control and reversing thrust.

5. A pump for propelling a boat, comprising:

a pump housing having a central impeller cavity;

inlet passage means communicating with the said impeller cavity;

a substantially horizontal pump shaft extending centrally through and being rotatably mounted in said housing;

a double-suction radial flow impeller positioned within said impeller cavity and fixed to rotate with said shaft;

dual discharge volutes communicating with said impeller cavity, said dual volutes spiralling about said central impeller cavity substantially in a plane for approximately 360° and terminating laterally at opposite sides of said shaft;

a pair of outlet elbows associated respectively one with each of said dual volutes and at opposite sides of said housing, each one of said outlet elbows including a bend with an outlet part extending rearwardly along opposite sides of said housing with said parts in parallel relation and having a tapered inner diameter to provide a nozzle, said parts each terminating forwardly of the back of said pump housing; and a pair of non-rotatable discharge nozzles extending one from each of said elbow outlet parts adjacent said bends with the discharge ends of said discharge nozzles at generally the same level as said elbow outlet parts and directed rearwardly in the same direction as said second elbow outlet parts to avoid change in the direction of fluid flow.

* * * * *